United States Patent [19]

Long et al.

[11] Patent Number: 4,887,320

[45] Date of Patent: Dec. 19, 1989

[54] DUAL-VISOR ASSEMBLY WITH SELECTIVE LEFT-HANDED OR RIGHT-HANDED ACTUATION

[75] Inventors: Richard J. Long, Lake Ariel; Joseph J. Zaccone, Carbondale, both of Pa.

[73] Assignee: Gentex Corporation, Carbondale, Pa.

[21] Appl. No.: 253,943

[22] Filed: Oct. 5, 1988

Related U.S. Application Data

[63] Continuation of Ser. No. 68,835, Jul. 1, 1987, abandoned.

[51] Int. Cl.[4] ..... A42B 3/02

[52] U.S. Cl. ..... 2/424; 2/6

[58] Field of Search ..... 2/2.1 A, 6, 9, 171.4, 2/424, 425

[56] References Cited

U.S. PATENT DOCUMENTS

| | | | |
|---|---|---|---|
| 3,491,371 | 1/1970 | DeAngelis | 2/6 |
| 3,543,308 | 12/1970 | Stapenhill | 2/6 |
| 3,568,211 | 3/1971 | Petruzella, Jr. | 2/6 |
| 3,601,813 | 8/1971 | Aileo | 2/6 |
| 3,721,994 | 3/1973 | DeSimone et al. | 2/6 |
| 3,748,657 | 7/1973 | Aileo | 2/6 |
| 4,199,823 | 4/1980 | Jenkins et al. | 2/424 |
| 4,621,377 | 11/1986 | Pennell | 2/6 |

OTHER PUBLICATIONS

Gentex Corporation, "PRU-36/P Side Actuated Dual Visor Kit Assembly" (1983).

*Primary Examiner*—Wm. Carter Reynolds
*Attorney, Agent, or Firm*—Shenier & O'Connor

[57] ABSTRACT

A dual-visor assembly in which the inner and outer visors are capable of selective left-handed or right-handed actuation to suit a particular operator or operating condition. The inner-visor actuator comprises a lever arm that extends laterally beyond a side edge of the visor through one of a first pair of slots formed in the visor housing. A pin carrried by the arm is resiliently biased into engagement with a detented surface to lock the inner visor in a desired position. Preformed apertures on the left and right sides of the visor permit the actuator lever to be selectively secured to the desired side. The outer-visor actuator comprises a knob carried by a key that fits into either of a pair of keyholes formed on opposite sides of the outer visor. The knob extends through one of a second pair of slots formed in the visor housing at locations opposite the keyholes and is turned to clamp the visor housing to lock the outer visor at the desired position.

20 Claims, 5 Drawing Sheets

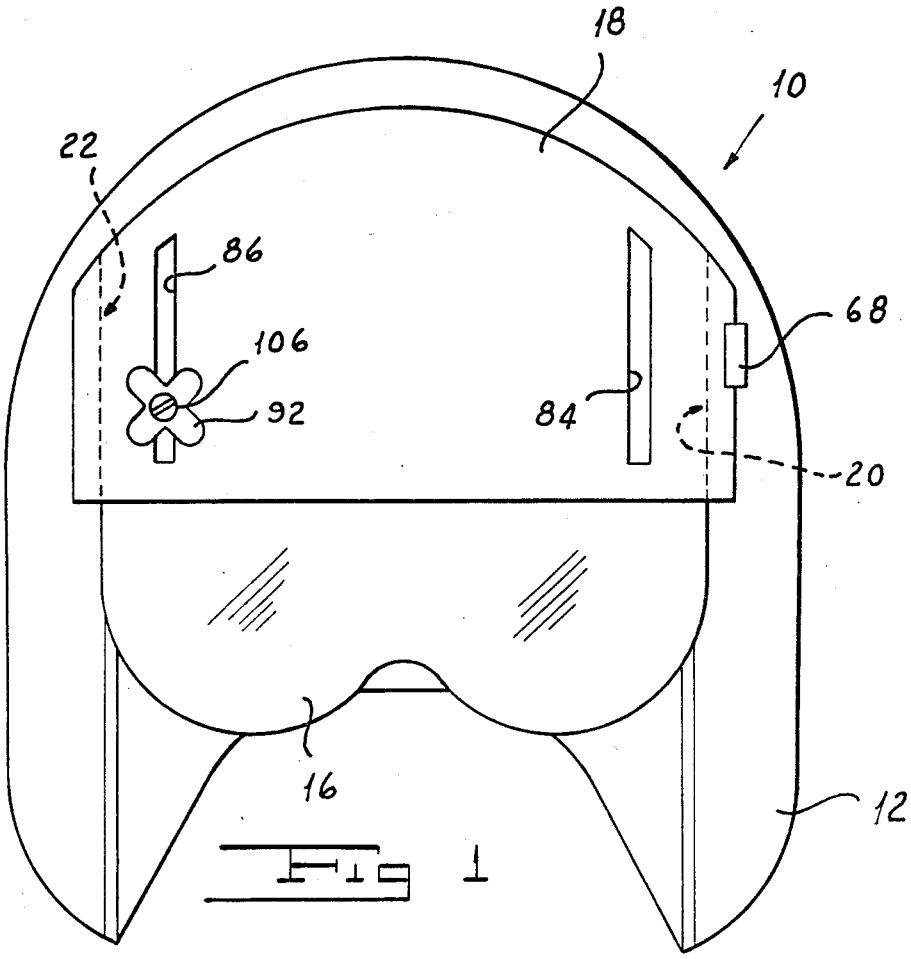
Fig 1
Fig 5
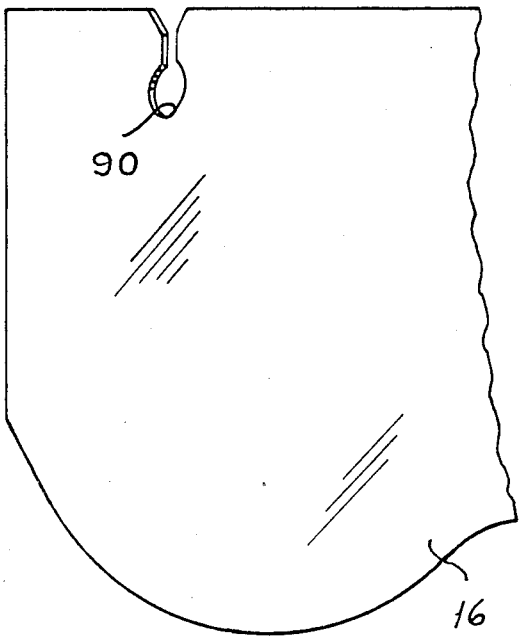
Fig 6
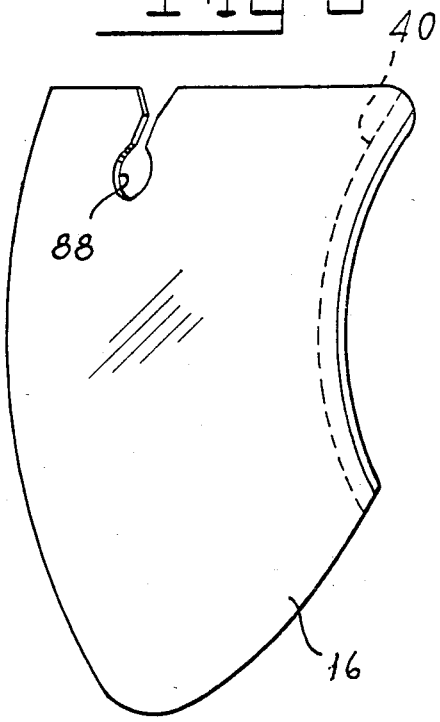

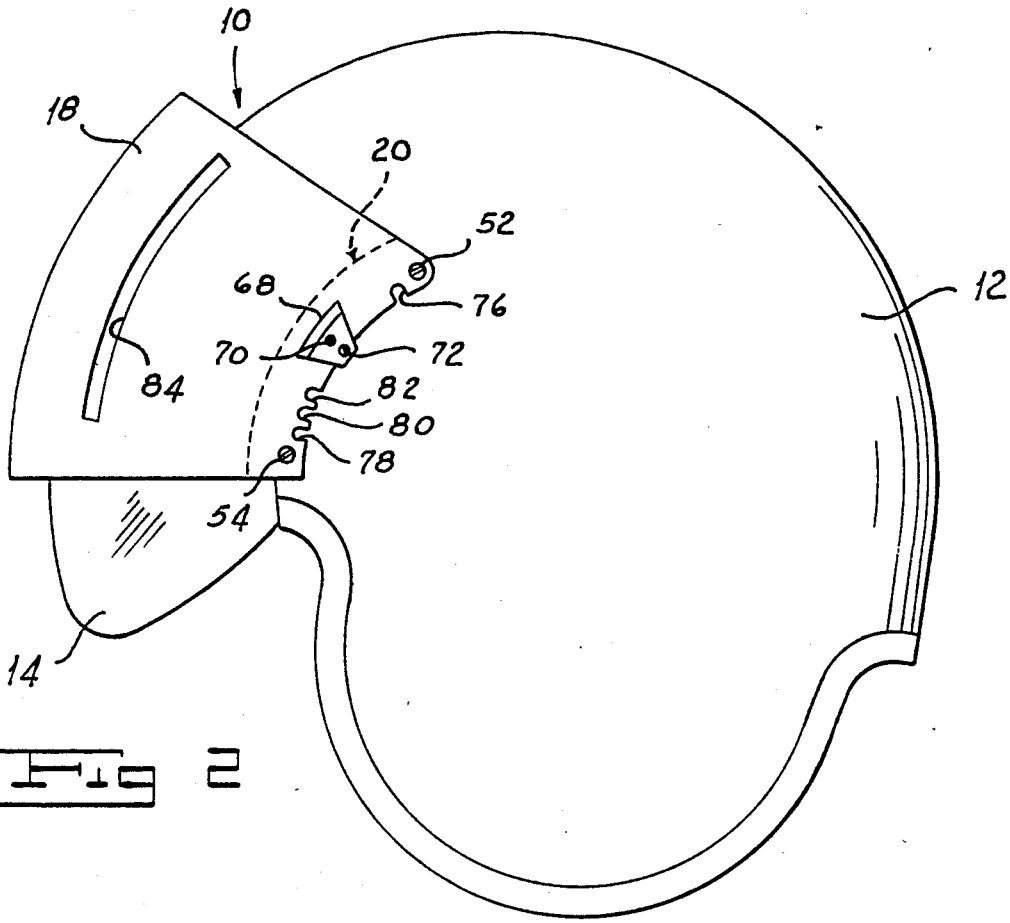
Fig 2
Fig 10
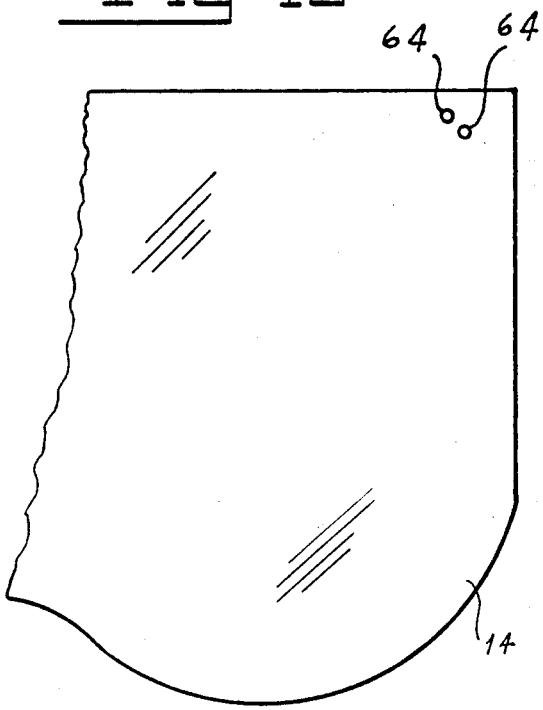
Fig 11
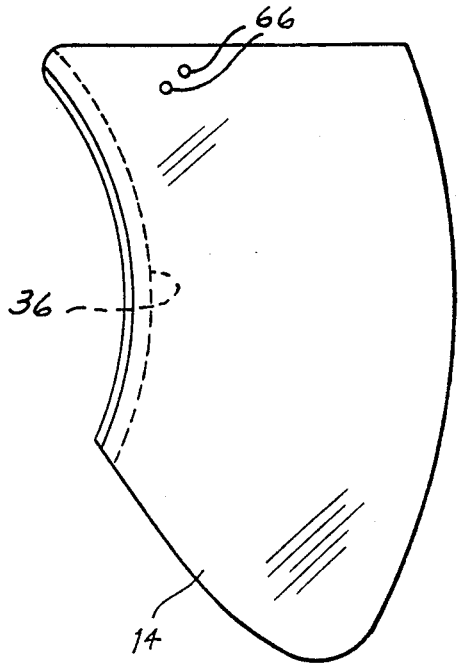

Fig 8
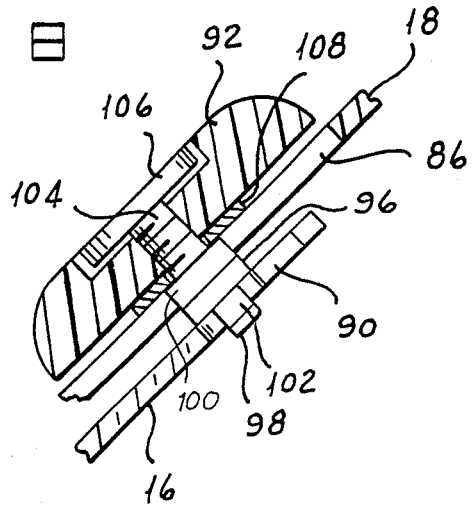
Fig 9
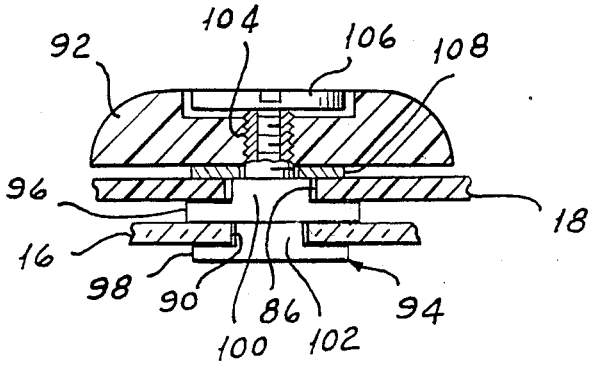
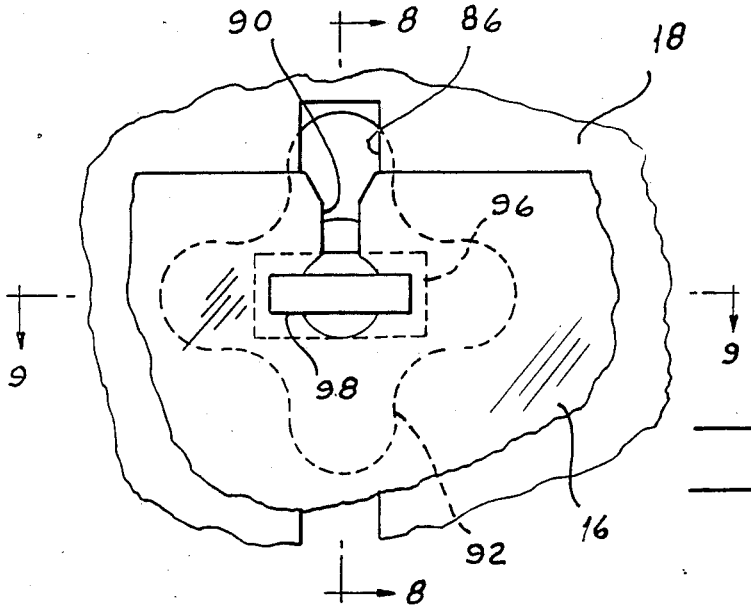
Fig 7

DUAL-VISOR ASSEMBLY WITH SELECTIVE LEFT-HANDED OR RIGHT-HANDED ACTUATION

This is a continuation of co-pending application Ser. No. 068,835, filed on July 1, 1987.

BACKGROUND OF THE INVENTION

Our invention relates to a dual-visor assembly for use with a helmet such as that worn by an aircraft crewmember or the like.

Dual-visor assemblies for aircraft crewmembers' helmets or the like are well known in the art. In one such assembly, shown in Aileo U.S. Pat. No. 3,601,813, an inner visor and an outer visor are controlled by respective actuator knobs that extend outwardly through slots formed in the visor housing. Each knob may be moved up or down along the slot to raise or lower the visor and may be rotated to clamp the adjacent slot wall and thus immobilize the visor. One obvious limitation of this assembly is that the inner visor cannot be lowered without also lowering the outer visor.

In another dual-visor assembly known in the art, the outer visor is controlled by a lever that extends laterally beyond the left edge of the visor, while the inner visor is similarly controlled by a lever that extends beyond the right edge of that visor. Each actuator lever is resiliently biased into engagement with a rack or series of detents to provide a nearly continuous range of locked positions. Although this latter assembly permits lowering of the inner visor independently of the outer visor, the fixed arrangement of the actuator levers limits the versatility of the visor assembly. Thus, it has been found that the optimum configuration of the visor actuators depends on a number of factors, including the type of aircraft that is being flown, whether the wearer's seat is on the left or on the right, whether the wearer is left-handed or right-handed, and the particular mission or activities of the wearer. Neither of the prior-art assemblies described above is fully adaptable to all of these changes in operating environment.

SUMMARY OF THE INVENTION

One object of our invention is to provide a visor assembly which may be used with equal facility by left-handed or right-handed operators.

Another object of our invention is to provide a visor assembly which is adaptable for use in aircraft of various designs.

A further object of our invention n is to provide a visor assembly which is adaptable for use at various locations in an aircraft.

Still another object of our invention is to provide a visor assembly which is adaptable for use while performing various activities.

Other and further objects will be apparent from the following description.

In general, our invention contemplates a visor assembly for a helmet in which means are provided for securing a visor to the helmet for movement between a lowered position in front of the wearer's face and a raised position clear of the wearer's face and in which means are provided on each side of the visor for securing an actuator to that side. In a preferred form of our invention, an inner visor and an outer visor are movable into a housing formed with a first pair of slots adjacent to the side edges of the visors and with a second pair of slots inboard of the first pair of slots. Means are provided on each side of the inner visor for securing thereto a first actuator which extends through one of the first pair of slots, while means are provided on each side of the outer visor for securing thereto a second actuator which extends through one of the second pair of slots. Preferably, the first actuator comprises a resilient lever arm adapted to engage one of a plurality of detents in the adjacent visor housing, while the second actuator comprises a knob which may be turned to clamp the adjacent portion of one of the second pair of slots.

BRIEF DESCRIPTION OF THE DRAWINGS

In the accompanying drawings to which reference is made in the instant specification and which are to be read in conjunction therewith and in which like reference characters are used to indicate like parts in the various views:

FIG. 1 is a front elevation of a helmet fitted with our dual-visor assembly.

FIG. 2 is a left side elevation of the helmet shown in FIG. 1.

FIG. 5 is a fragmentary front elevation of the outer visor of the assembly of FIG. 1.

FIG. 6 is a left side elevation of the outer visor of the assembly shown in FIG. 1.

FIG. 7 is a fragmentary view, looking outwardly toward the inner surface of the outer visor, showing the outer visor locking knob when fitted into the right slot of the assembly of FIG. 1.

FIG. 8 is a fragmentary section of the portion of the dual-visor assembly shown in FIG. 7, taken along line 8—8 thereof.

FIG. 9 is a fragmentary section of the portion of the dual-visor assembly shown in FIG. 7, taken along line 9—9 thereof.

FIG. 10 is a fragmentary front elevation of the inner visor of the assembly shown in FIG. 1.

FIG. 11 is a right side elevation of the inner visor of the assembly shown in FIG. 1.

DESCRIPTION OF THE PREFERRED EMBODIMENT

Figure 3:
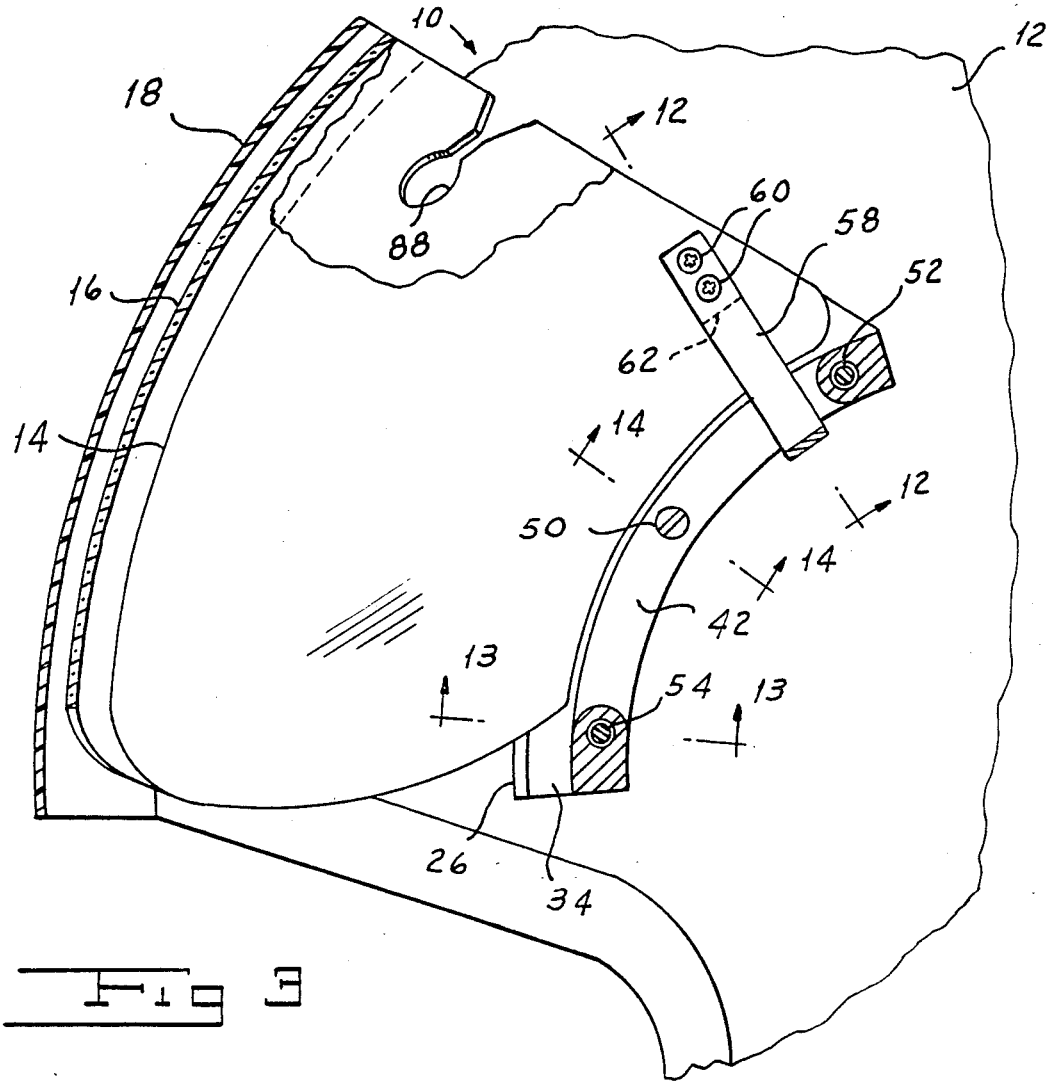
FIG. 3 is an enlarged fragmentary left side elevation of the dual-visor assembly of FIG. 1, with parts broken away or in section.
Figure 4:
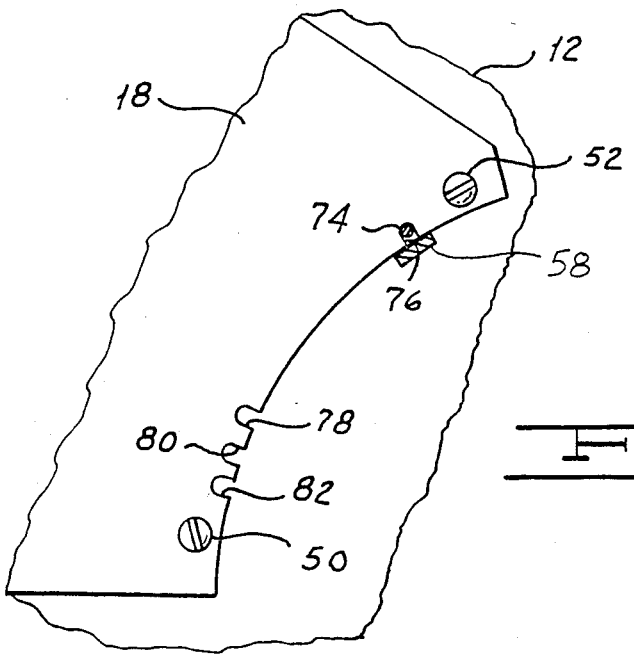
FIG. 4 is a fragmentary left side elevation of the left portion of the dual-visor assembly shown in FIGURE 1.

Referring now to FIGS. 1 to 4, our dual-visor assembly, indicated generally by the reference numeral 10, is intended to be used with a rigid helmet shell 12 of any suitable material known to the art. Assembly 10 includes an inner visor 14 and an outer visor 16, each of which is movable between a lower position in front of the wearer's face and a raised position clear of the wearer's face.

Typically, visors 14 and 16 have differing transmission characteristics, inner visor 14 being clear and outer visor 16 being tinted a neutral gray, for example. In addition to differing in their visible transmission characteristics, visors 14 and 16 may be formulated to absorb incident laser radiation of selected wavelengths, such as neodymium laser radiation at 1064 nanometers or ruby laser radiation at 694 nanometers. The present invention, however, does not relate to the transmission characteristics of the visors 14 and 16 as such. Visors 14 and 16 are formed of suitable impact-resistant plastic, polycarbonate being a preferable material.

A housing cover 18 secured to the upper front portion of the shell 12 protects the visors 14 and 16 in their raised positions above the wearer's face. A left track assembly indicated generally by the reference numeral 20 and a right track assembly indicated generally by the reference numeral 22, which together with cover 18 form the visor housing space the housing cover 18 from the surface of shell 12 and guide the movement of the visors between their raised and lowered positions. Track assemblies 20 and 22 are mirror images of each other; the detailed description that follows for left track assembly 20 applies equally well to the right track assembly 22, except of course for the reversal of parts.

Figure 12:
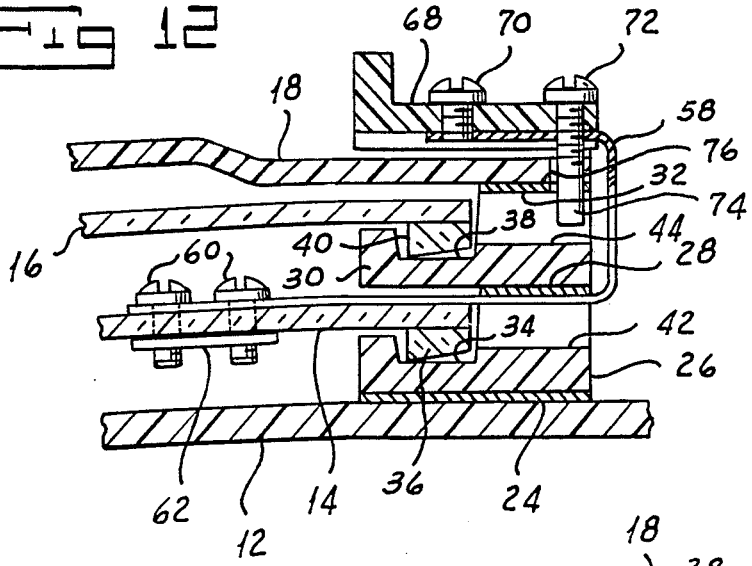
FIG. 12 is a fragmentary section of the left track assembly the dual-visor assembly shown in FIG. 1, taken along line 12—12 of FIG. 3.
Figure 13:
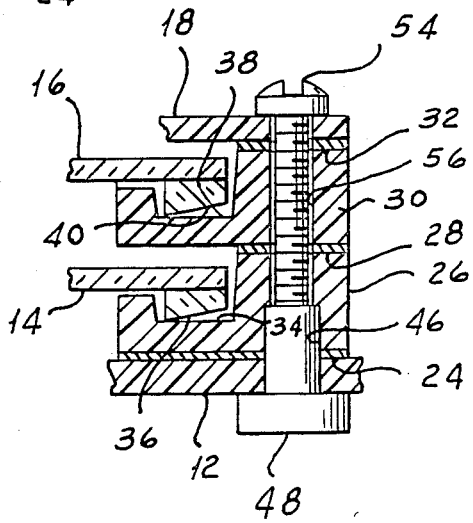
FIG. 13 is a fragmentary section of the track assembly shown in FIG. 12, taken along line 13—13 of FIG. 3.
Figure 14:
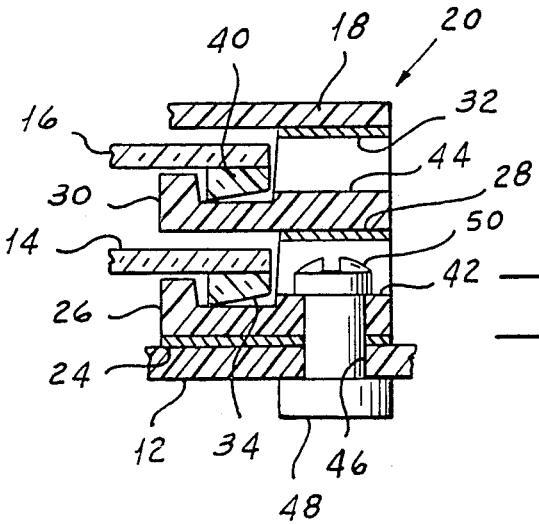
FIG. 14 is a fragmentary section of the track assembly shown in FIG. 12, taken along line 14—14 of FIG. 3.

Referring now also to FIGS. 12 to 14, the left track assembly 20 includes a lower track 26 for receiving the inner visor 14 and an upper track 30 for receiving the outer visor 16. A lower spacer 24, the thickness of which may vary along its length to conform to the contour of shell 12, spaces the lower track 26 from the shell 12. In a similar manner, a middle spacer 28 separates upper track 30 from lower track 26, while a metal upper spacer 32 separates housing cover 18 from upper track 30. Lower track 26 has an upwardly opening channel 34 extending along its inner periphery for receiving one of a pair of flanges 36 extending along the side edges of the inside surface of inner visor 14. Upper track 30 likewise has an upwardly opening channel 38 along its inner periphery for receiving one of a pair of flanges 40 adhered to the side edges of the inside surface of outer visor 16. Tracks 26 and 30 have stepped surface portions 42 and 44, respectively, between their upper and lower ends to reduce weight and to provide access to the edge of inner visor 14.

Referring to FIGS. 3, 4, 13 and 14, shell 12, lower spacer 24 and lower track 26 have bores 46 at the upper and lower ends of the track assembly 20 and at a location intermediate said ends. Bores 46 receive posts 48 that are pushed upwardly through the bores 46 from the underside of the shell 12. Posts 48 have internal threads (not shown) for receiving screws for securing the various components of the track assembly 20 to the shell 12. Thus, referring to FIG. 14, the intermediate post 48 receives a screw 50 that clamps lower track 26 and lower spacer 24 between the heads of screw 50 and the post 48. Elements 26 to 32 and cover 18 have smaller-diameter bores 56 at the upper and lower ends of track 20 at locations opposite bores 46 for receiving upper and lower screws 52 and 54 which engage the threads of posts 48.

Referring also to FIGS. 10 and 11, inner visor 14 has preformed pairs of apertures 64 and 66 on the left and right sides, respectively, for alternative mounting of a C-shaped lever arm 58 on the left or the right side of the visor. In the drawings and in the description that follows, it is assumed that the lever arm 58 is mounted on the left side of the visor 14. Respective screws 60 received by a plate 62 on the inner surface of visor 14 secure lever arm 58 to the outer surface of the visor. As shown in FIG. 12, lever arm 58 extends laterally beyond the side edge of visor 14 through the slot or channel defined by stepped portion 42 and middle spacer 28. Lever arm 58 then extends outwardly away from shell 12 and then back to the right, as viewed in FIG. 12, just above the adjacent portion of cover 18. A plastic handle 68 is secured to the upper portion of lever arm 58 by a first screw 70 relatively remote from the edge of cover 18 and by a second screw 72 relatively adjacent to the edge portion of cover 18. Cover 18 and upper spacer 32 are each formed with an upper detent 76 and three spaced lower detents 78, 80 and 82 for receiving an unthreaded portion 74 of screw 72 to retain lower visor 14 in a position defined by the particular detent engaged by screw portion 74. Normally, the resilience of lever arm 58 biases screw portion 74 into one of the detents 76 to 82. To change the position of the visor 14, the user pulls handle 68 laterally to remove portion 74 from the detent. A plurality of lower detents allow the lower position of visor 14 to be adjusted for the individual wearer, as well as for any oxygen mask (not shown) or other equipment with which the helmet shell 12 is used.

In accordance with our invention, lever arm 58 may readily be transferred to the right side of visor 14 if such placement is preferably in a given situation. To effect this change, the user first removes the lower screw 54 of each of the track assemblies 20 and 22. The user then removes the visor 14 from the lower end of the cover 18, lifting the left middle spacer 28 slightly from the adjacent lower track 26 to permit lever arm 58 to clear the unstepped lower portion of track 26. The user then removes screws 60 from apertures 64 and plate 62 and reattaches the lever arm 58 in the same manner to the right side of the visor 14, using preformed apertures 66. The user then reinserts the visor 14 into the cover 18, lifting this time the lower right side of the housing cover to permit arm 58 to clear track 26. When the visor 14 is properly in position again, the user reinserts lower screws 54. As an alternative to this procedure, it is also possible, of course, to have separate lever arms 58 simultaneously attached to each side of the visor 14.

Referring again to FIGS. 1 to 4, housing cover 18 has a pair of vertically extending slots 84 and 86 formed on its left and right sides, respectively inboard of the pair of slots defined by portions 28 and 42 of track assemblies 20 and 22. Referring now to FIGS. 5 and 6, outer visor 16 has respective keyholes 88 and 90 formed in its upper edge on the left and right sides, respectively, at positions aligned with slots 84 and 86. Each of keyholes 88 and 90 is adapted to accept first threaded member, or key, indicated generally by the reference numeral 94, for mounting a second threaded member, or locking knob, 92. In the drawings and in the description that follows, it is assumed that the locking knob 92 and key 94 are mounted in the right keyhole 90. The operation would, of course, be similar if the same parts were mounted in the left keyhole 88.

Referring particularly to FIGS. 7 to 9, key 94 includes rectangular upper and lower flanges 96 and 98, between which outer visor 16 is sandwiched, and a rectangular portion 102 extending through keyhole 90 between flanges 96 and 98. As described in Aileo U.S. Pat. No. , 3,601,813, portions 98 and 102 are so dimensioned that key 94 may be inserted into keyhole 90 by first orienting flanges 96 and 98 vertically, then inserting key 94 into keyhole 90, either inwardly through the slot portion or downwardly through the upper opening, and then rotating the key 90° to the position shown in FIG. 7 to lock the key 94 inside keyhole 90.

A rectangular portion 100 of key 94 extending upwardly through slot 86 in cover 18 carries a post 104 which extends outwardly beyond th surface of cover 18. An internal thread formed in button 92 engages an external thread formed on post 104. To immobilize the key 94 and hence the outer visor 16 at a given position along slot 86, the user rotates knob 92 to clamp the adjacent portions of cover 18 between upper flange 96 and a washer 108 carried by post 104 between knob 92 and cover 18. To release the key 94 to permit the visor 16 to be moved to another position along slot 86, the user rotates knob 92 in the opposite direction. A retaining screw 106 received by an internal thread formed in post 104 holds knob 92 on post 104. Preferably, the internal thread of post 104 is counter to that of the external thread to prevent inadvertent removal of the knob 92 together with the screw 106.

To transfer locking knob 92 from right slot 86 to left slot 84, the wearer first removes screw 106 and then knob 92 and washer 108 from post 104. The wearer than flexes outer visor 16 inwardly away from cover 18 to free portion 100 from slot 86. When this is done, the wearer may rotate key 94 a quarter turn and remove it from slot 86 and keyhole 90. The wearer then inserts the key 94 into keyhole 88 and slot 84. Thus, the wearer may independently mount actuator members 58 and 92 for either right-handed or left-handed operation in accordance with his needs, using nothing other than a screwdriver for screws 54.

It will be seen that we have accomplished the objects of our invention. Our visor assembly may be used with equal facility by left-handed or right-handed operators. Further, our visor assembly may be used in aircraft of various designs, as well as in various locations of an aircraft. Finally, our assembly is adaptable for use while performing various activities.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A visor assembly for a helmet including in combination a visor and an actuator for moving said visor between raised and lowered positions relative to the wearer's face, said visor having means on each side thereof for securing said actuator to that side, said actuator being adapted to be secured to one side of said visor by means of the securing means on said side, said actuator being adapted to be removed from said one side and secured to the other side of said visor by means of the securing means on said other side.

2. An assembly as in claim 1 including means for securing said visor to said helmet for movement between said positions.

3. An assembly as in claim 1 including means for locking said visor in one of said positions.

4. An assembly as in claim 1 in which each of said means for securing said actuator to a side of said visor is formed with an aperture, said actuator having a portion adapted to fit into said aperture.

5. An assembly as in claim 1 including a housing adapted to be mounted over the front of said helmet to receive said visor in said raised position, said housing being formed with a pair of slots on opposite sides thereof, said actuator being adapted to extend through one of said slots when secured to said visor.

6. An assembly as in claim 5 in which said housing is formed with a detent, said actuator being adapted to engage said detent.

7. An assembly as in claim 5 in which said actuator comprises a first threaded member adapted to be secured to said visor and a second threaded member adapted to be carried by said first threaded member outside of said housing.

8. A dual-visor assembly for a helmet including in combination an inner visor, an outer visor, a housing, means for mounting said housing over the front of said helmet, means for mounting said visors for movement between lowered positions in front of the wearer's face and raised positions within said housing with said inner visor spaced inwardly of said outer visor, said housing being formed with a first slot adjacent to a side edge of said inner visor and with a second slot inboard of said first slot, a first actuator for moving said inner visor between said positions, said inner visor having means on one side thereof for securing said first actuator to said side so as to extend through said first slot, and a second actuator secured to said outer visor for moving said outer visor between said positions, said outer visor having means on said one side thereof for securing said second actuator to said side so as to extend through said second slot.

9. An assembly as in claim 8 in which said housing is formed with a first pair of slots adjacent to the side edges of said inner visor and with a second pair of slots inboard of said first pair of slots, said first slot constituting one of said first pair of slots and said second slot constituting one of said second pair of slots, each of said visors having means on each side thereof for securing the corresponding actuator to that side so as to extend through one of said slots.

10. A dual-visor assembly for a helmet including in combination an inner visor, an outer visor, means for mounting said visors for movement between lowered positions in front of the wearer's face and raised positions clear of the wearer's face with said inner visor spaced inwardly of said outer visor, a first actuator for moving said inner visor between said positions, said inner visor having means on one side thereof for securing said first actuator to said side so as to extend laterally from said inner visor, and a second actuator for moving said outer visor between said positions, said outer visor having means on said one side thereof for securing said second actuator to said side so as to extend outwardly from said outer visor.

11. An assembly as in claim 20 in which each of said visors also has means on the other side thereof for securing an actuator to said side.

12. An assembly as in claim 10 including a housing adapted to be mounted over the front of said helmet to receive said visors in said raised positions, said housing being formed with respective slots for receiving said actuators.

13. An assembly as in claim 11 in which each of said actuators is adapted to be removed from one side and secured to the other side of the corresponding visor by means of the securing means on said other side.

14. A dual-visor assembly for a helmet including in combination an inner visor, an outer visor, means for mounting said visors for movement between lowered positions in front of the wearer's face and raised positions clear of the wearer's face with said inner visor spaced inwardly of said outer visor, a first actuator for moving said inner visor between said positions, said inner visor having means on one side thereof for securing said first actuator to said side at a location relatively adjacent to a side edge of said inner visor, and a second actuator for moving said outer visor between said positions, said outer visor having means on said one side thereof for securing said second actuator to said side at a location relatively remote from the corresponding side edge of said outer visor.

15. An assembly as in claim 14 including a housing adapted to be mounted over the front of said helmet to receive said visors in said raised positions, said housing being formed with respective slots for receiving said actuators.

16. An assembly as in claim 14 in which each of said visors also has means on the other side thereof for securing an actuator to said side.

17. An assembly as in claim 16 in which each of said actuators is adapted to be removed from one side and secured to the other side of the corresponding visor by means of the securing means on said other side.

18. An assembly as in claim 14 in which said first actuator is adapted to extend laterally from said inner visor.

19. An assembly as in claim 14 in which said second actuator is adapted to extend outwardly from said outer visor.

20. An assembly as in claim 14 in which said first actuator is adapted to extend laterally from said inner visor and said second actuator is adapted to extend outwardly from said outer visor.

* * * * *

UNITED STATES PATENT AND TRADEMARK OFFICE

CERTIFICATE OF CORRECTION

PATENT NO. : 4,887,320

DATED : December 19, 1989

INVENTOR(S) : Richard J. Long, Joseph J. Zaccone

It is certified that error appears in the above-identified patent and that said Letters Patent is hereby corrected as shown below:

In the Claims:

Col. 6, line 57, change "20" to --10--.

Signed and Sealed this

Eighteenth Day of September, 1990

*Attest:*

*Attesting Officer*

HARRY F. MANBECK, JR.

*Commissioner of Patents and Trademarks*